US006209150B1

(12) United States Patent
Hsu et al.

(10) Patent No.: US 6,209,150 B1
(45) Date of Patent: Apr. 3, 2001

(54) INFLATABLE SUN SHADE FOR POOL

(75) Inventors: Yaw-Yuan Hsu, Taipei; Chin-Hsiang Pan, Taipei Hsien; Kun Chao Hsu, Taipei, all of (TW)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 09/457,928

(22) Filed: Dec. 8, 1999

(51) Int. Cl.[7] ..... E04H 4/00
(52) U.S. Cl. ..... 4/506; 4/585; 4/499
(58) Field of Search ..... 4/506, 585, 588, 4/586, 499; 135/96, 124, 126, 136, 115; 52/2.18, 2.19, 3, 169.7, DIG. 13; 441/38

(56) References Cited

U.S. PATENT DOCUMENTS

| | | | | |
|---|---|---|---|---|
| 2,838,768 | * | 6/1958 | Fishchett | 4/507 |
| 3,054,124 | * | 12/1962 | Silverstone | 441/38 |
| 3,769,647 | | 11/1973 | Basa | 9/400 |
| 4,030,748 | | 6/1977 | Brock | 297/184 |
| 4,799,910 | | 1/1989 | Kellough | 441/131 |
| 4,865,381 | | 9/1989 | Van Rogue | 297/184 |
| 5,190,194 | | 3/1993 | Rosner et al. | 224/0.5 |
| 5,299,588 | | 4/1994 | MacLeod | 135/16 |
| 5,320,405 | | 6/1994 | Foster et al. | 297/184.17 |
| 5,356,354 | | 10/1994 | Owens | 482/35 |
| 5,394,822 | | 3/1995 | Worland | 114/345 |
| 5,441,067 | | 8/1995 | James et al. | 135/96 |
| 5,458,517 | | 10/1995 | Ellis | 441/129 |
| 5,482,755 | | 1/1996 | Manning | 428/95 |
| 5,690,133 | | 11/1997 | Capwell | 135/124 |
| 5,797,650 | | 8/1998 | Gonzalez, Jr. et al. | 297/184.1 |
| 5,943,709 | * | 8/1999 | Chiu | 4/506 |
| 5,987,822 | * | 11/1999 | McNiff et al. | 52/2.11 |

FOREIGN PATENT DOCUMENTS

| | | | | |
|---|---|---|---|---|
| 226884 | * | 11/1958 | (AU) | 441/38 |
| 1162793 | * | 8/1969 | (GB) | 441/38 |

* cited by examiner

*Primary Examiner*—Gregory L. Huson
*Assistant Examiner*—Huyen Le
(74) *Attorney, Agent, or Firm*—Lewis, D'Amato, Brisbois & Bisgaard, LLP

(57) ABSTRACT

A sun shade pool typically used by small children in an above-the-ground environment for use in the out-of-doors and method therefore is disclosed which is directed to an inflatable pool and a removable sun shade canopy mounted upon the inflatable pool for blocking direct sun light. The inflatable pool can be multiple-tiered in height and include a bottom wall. The removable sun shade canopy is attachable to and detachable from a top surface of the inflatable pool by a plurality of hook and loop fasteners. The sun shade pool can be fashioned from polyvinylchloride sheeting, include a plurality of inflation air valves for inflating the pool and canopy, and a drain plug for rapidly draining water from the pool. In its most fundamental embodiment, the sun shade pool exhibits a construction including an inflatable pool having a sidewall sealed to a bottom wall for containing a fluid. A removable sun shade canopy for covering a top surface of the inflatable pool is also included. The canopy incorporates a pair of inflatable arched tubes attachably and detachably mounted to the top surface of the inflatable pool by a plurality of hook and loop fasteners. A sun blocking fabric is also suspended between the pair of inflatable arched tubes.

13 Claims, 5 Drawing Sheets

INFLATABLE SUN SHADE FOR POOL

BACKGROUND OF THE INVENTION

1. Field of the Invention

The present invention relates to above-the ground, flexible plastic, inflatable-type swimming pools. More specifically, the present invention relates to methods and apparatus for a children's wading pool having a multiple-tier, inflatable sidewall and a bottom wall and includes a sun shade canopy that covers the pool and is supported by a pair of inflatable arched tubes which are attachable to and removable from the top of the wading pool by hook and loop fastener means.

2. Description of the Prior Art

The prior art is directed to methods and apparatus for above-the-ground inflatable swimming or wading pools typically fashioned from polyvinylchloride sheeting, having a sun blocking canopy, and used in the out-of-doors.

Swimming and wading pools intended for use by children and comprised of inflatable plastic materials such as polyvinylchloride (hereinafter "PVC") sheeting and having a multiple-tier inflatable sidewall including appropriate air valves and a plastic bottom wall are known in the art. These swimming and wading pools are intended to hold a minimum amount of water to enable one or more small children to play therein and splash the water on warm days.

Likewise, devices intended to shade people from the direct rays of the sun are also known in the art. For example, several aquatic lounge and floatation devices have been known. These devices do not themselves contain water, i.e., they are not a swimming or wading pool, but are designed to float within a larger body of water such as a swimming pool, pond, lake and the like. For example, one known device is an aquatic lounge having a pair of generally parallel, spaced-apart longitudinally extending buoyant members intended to float in a swimming pool or the like. The aquatic lounge includes a head rest having a small canopy for shading the face of an individual resting on the lounge. The shade canopy is removable from the head rest via a plurality of threaded mechanical fasteners. The aquatic lounge also includes a serving tray attachment having a small canopy positioned thereover for protecting, for example, soft drinks from direct sun light on warm days.

Another known device is a recreational floating apparatus typically used by small children with the assistance of an adult. This device is also an aquatic floatation mechanism which includes a circular foamed plastic float, a supporting fabric seat and an attached frame collapsible canopy. The supporting seat is adapted to support a small child or infant in an upright position. The collapsible canopy is adapted to partially cover the occupant of the floating apparatus to provide protection from the sun. A third known device includes a similar floatation device which can serve as a seat and includes an umbrella shade mechanism positioned directly over the floatation portion of the device. Yet another similar device discloses an umbrella support for attachment to a recreation floatation device such as a large intertube equipped with seats. The umbrella support includes a socket for mounting the support shaft of a sun shade umbrella therein.

Another device is characterized by an inflatable raft-like floatation device for use in, for example, a swimming pool. The raft-like device includes a series of communicating compartments wherein an outermost compartment pair is extendedly formed into a sun shade support. A sun shade having a fixed portion and an adjustable portion is affixed to the sun shade support. Another known device discloses a floating sun shield which has a rectangular floating frame and an arched sun shield canopy mounted over the rectangular floating frame. The floating frame can be comprised of polyvinylchloride and the sun shield canopy can be preferably formed of nylon fabric or similar materials. The arched portion of the canopy can include structural support rods. Many other sun shade type devices are also known in the art and are used typically with, for example, lounge chairs or the like. These sun shade type devices are also removable and replaceable but only via mechanical attachment means.

Thus, there is a need in the art for a children's wading or swimming pool having a multiple-tier, inflatable sidewall and a bottom wall, and where the swimming pool also includes a sun shade canopy where the canopy is supported by a pair of inflatable arched tubes and is quickly attachable to and removable from the top surface of the wading pool by hook and loop fasteners.

SUMMARY OF THE INVENTION

Briefly, and in general terms, the present invention provides a new and improved sun shade pool and method therefore typically used by small children as an above-the-ground wading pool. The sun shade pool includes an inflatable pool and a removable sun shade canopy mounted upon the inflatable pool for blocking direct sun light on warm days. The inflatable pool can be multiple-tiered in height, include a bottom wall and be fashioned from polyvinylchloride sheeting, include a plurality of inflation air valves for inflating the pool and a drain plug for rapidly draining water from the pool.

In a preferred embodiment, the removable shade canopy is attachable to and detachable from a top surface of the inflatable pool by a plurality of hook and loop fasteners. The sun shade canopy is formed from a pair of inflatable arched tubes and a sun blocking fabric suspended therebetween. Each of the inflatable arched tubes are generally identical in form, are separated by a pair of inflatable cross members which provide structural support, include an inflation air valve, and are inflated into a generally U-shaped tubular arch. The pair of inflatable arched tubes are mounted on opposite sides of the top surface of the inflatable pool. The sun blocking fabric is suspended between the inflatable arched tubes and over the inflatable cross members by attaching the fabric to each of the arched tubes by a known method such as by the use of radio frequency sealing or an adhesive. The inflatable arched tubes, inflatable cross members, and the sun blocking fabric can also be comprised of polyvinylchloride sheeting. However, the sun blocking fabric can also be formed of other known natural materials.

In the present invention, the sun shade canopy is attachable to and detachable from the inflatable pool by a plurality of hook and loop fasteners. The inflatable pool is typically rectangular in shape but is not limited to that geometric form. The top surface of a rectangular-shaped inflatable pool includes four corners. Each hook and loop fastener includes a hook portion and a loop portion. One suitable method of attachment and detachment of the sun shade canopy to the inflatable pool is to affix a hook portion of a hook and loop fastener to each of the two bottom ends of each of the pair of inflatable arched tubes. Likewise, the loop portions of the corresponding hook and loop fasteners are affixed to the top surface of the inflatable pool at each of the four corners. This design layout ensures that the hook portions will intersect with the corresponding loop portions and enables the sun shade canopy to be conveniently attached to and removed from the top surface of the inflatable pool.

The present invention is generally directed to a sun shade pool and method therefore typically used by children in an above-the-ground environment for use in the out-of-doors. The inventive sun shade pool provides an attractive and economic solution to parents with small children who seek relief from hot weather during the warm months of the year. The sun shade pool including the shade canopy enables the small child to enjoy the fun associated with splashing in water but simultaneously be protected from direct sun rays. Further, the sun shade pool provides these features without the necessity of the child being in the vicinity of a conventional swimming pool. In its most fundamental embodiment, the sun shade pool exhibits a construction including an inflatable pool having a sidewall sealed to a bottom wall for containing a fluid. A removable sun shade canopy for covering a top surface of the inflatable pool is also included. The canopy includes a pair of inflatable arched tubes attachably and detachably mounted to the top surface of the inflatable pool by a plurality of hook and loop fasteners. A sun blocking fabric is also suspended between the pair of inflatable arched tubes.

These and other objects and advantages of the present invention will become apparent from the following more detailed description, taken in conjunction with the accompanying drawings which illustrate the invention, by way of example.

DESCRIPTION OF THE INVENTION

Figure 1:
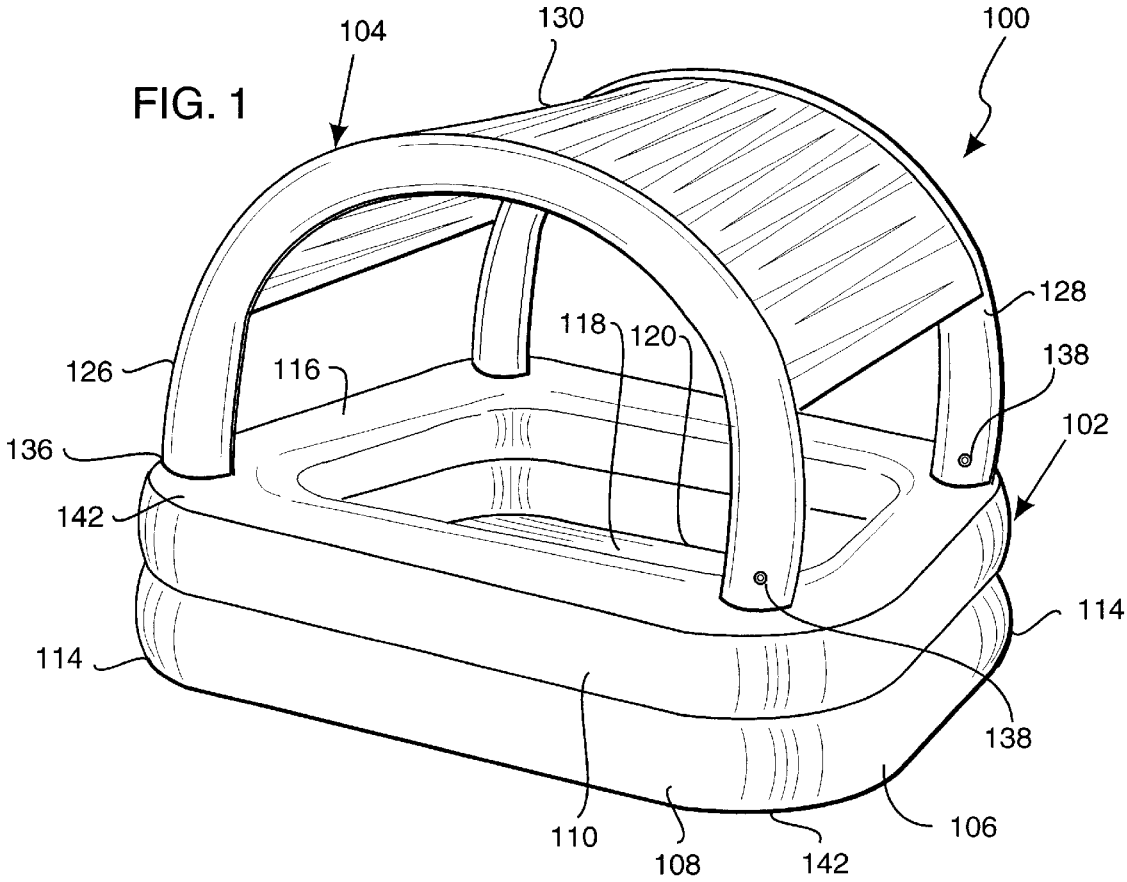
FIG. 1 is a perspective view of a sun shade pool and method showing a sun shade canopy comprising a pair of inflatable arched tubes mounted upon a children's inflatable pool via a plurality of hook and loop fasteners.
Figure 2:
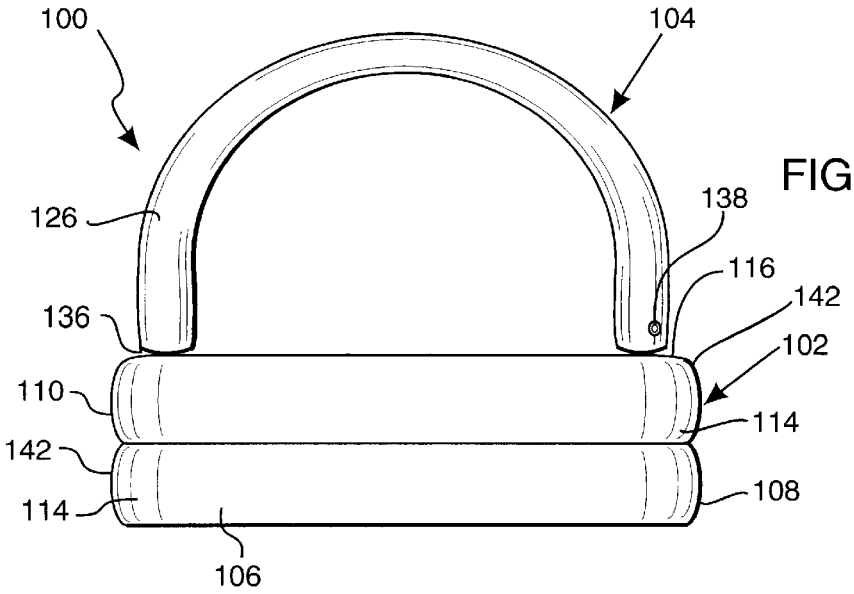
FIG. 2 is a front elevational view of the sun shade pool of FIG. 1 showing a first of the pair of inflatable arched tubes mounted on a top surface of a multiple-tier inflatable sidewall of the inflatable pool and an air valve located in the first of the inflatable arched tubes.

The present invention is a sun shade pool 100 typically used by children in an above-the-ground environment for use in the out-of-doors. The sun shade pool 100 includes an inflatable pool 102 and a removable sun shade canopy 104 as shown best in FIG. 1 but also in FIGS. 2–5. The inflatable pool 102 includes a continuous sidewall 106 comprising one or more vertical tiers. In the preferred embodiment, the continuous sidewall 106 includes two vertical tiers 108, 110, each comprised of a flexible inflatable material such as, for example, polyvinylchloride sheeting (typically referred to as PVC).

Figure 3:
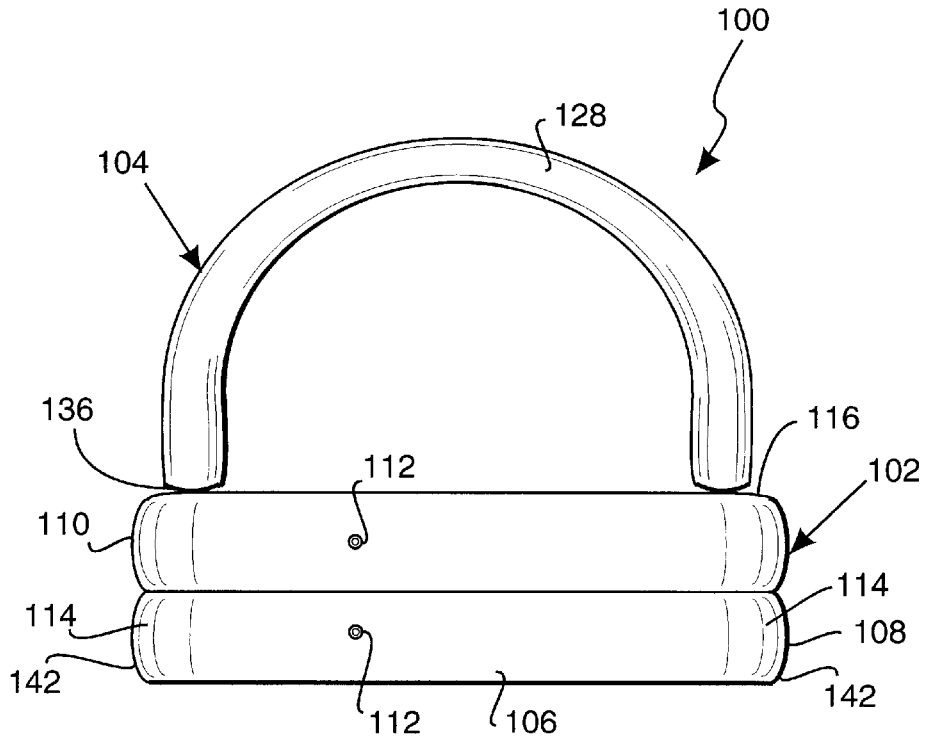
FIG. 3 is a rear elevational view of the sun shade pool of FIG. 1 showing a second of the pair of inflatable arched tubes mounted on the top surface of the multiple-tier inflatable sidewall and an air valve located in each of the tiers of the multiple-tier inflatable sidewall.
Figure 4:
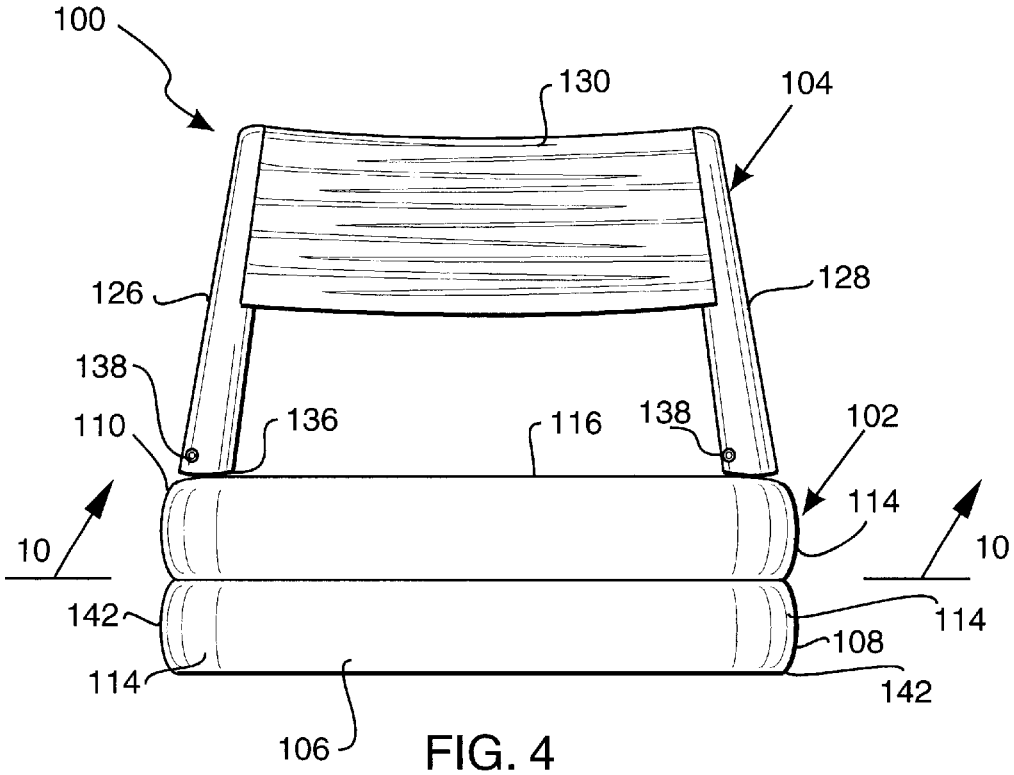
FIG. 4 is a left side elevational view of the sun shade pool of FIG. 1 showing a fabric attached to the tops of and extended between the pair of inflatable arched tubes to form the canopy mounted upon the inflatable sidewall of the inflatable pool.
Figure 5:
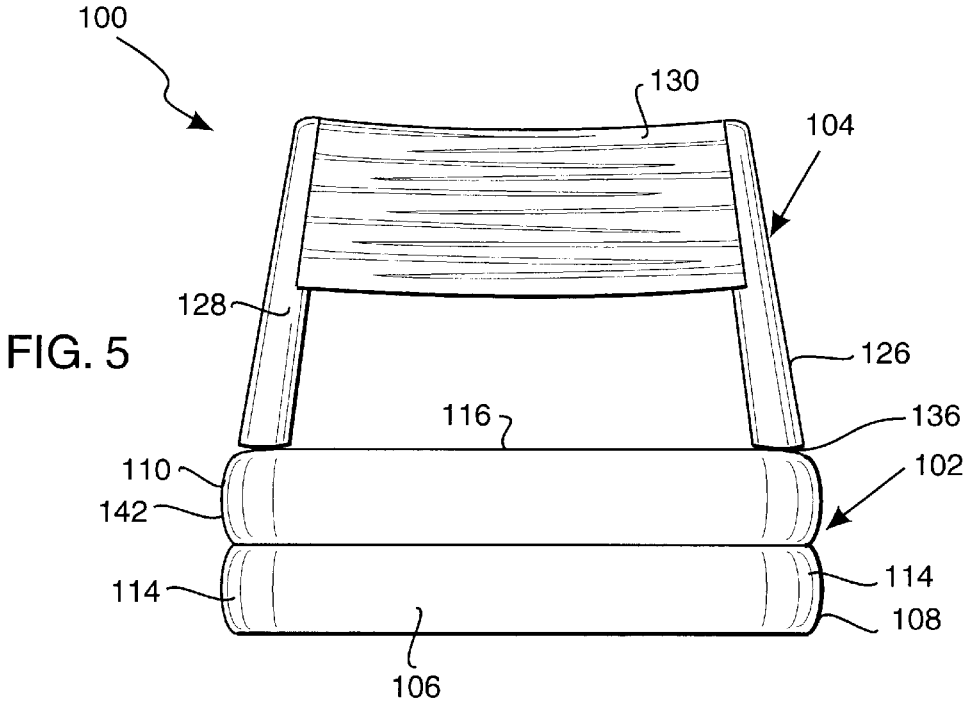
FIG. 5 is a right side elevational view of the sun shade pool of FIG. 1 showing the fabric attached to the tops of and extended between the pair of inflatable arched tubes to form the canopy mounted upon the inflatable sidewall of the inflatable pool.

The vertical tiers 108 and 110 are independent air chambers and are fused together by means known in the art such as, for example, radio frequency sealing. Since each of the two vertical tiers 108, 110 are independent air chambers, each includes an inflation air valve 112 as shown in FIG. 3 for the insertion and discharge of pressurized air. It follows that the gauge thickness of the polyvinylchloride sheeting of the vertical tiers 108, 110 is suitable for the air pressure with which the vertical tiers 108, 110 are charged. Since each of the vertical tiers 108 and 110 are charged with pressurized air, each of a plurality of side surfaces 114 are rounded as shown with the appropriate shading in FIGS. 1–5, 10 and 11.

Figure 6:
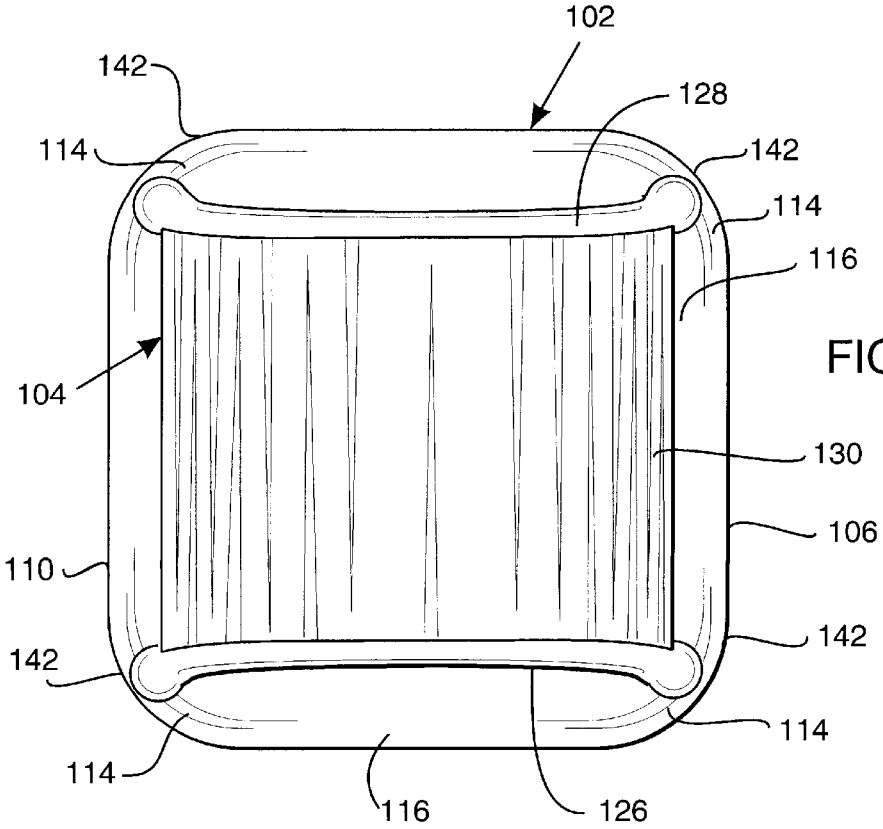
FIG. 6 is a top planar view of the sun shade pool of FIG. 1 showing the fabric of the sun shade canopy extended between the tops of the pair of inflatable arched tubes which are mounted on the top surface of the inflatable sidewall of the inflatable pool.

The upper vertical tier 110 of the continuous sidewall 106 has a top surface 116 which is continuous with the side surfaces 114 of the vertical tiers 108 and 110. The top surface 116 of the vertical tier 110 and the rounded side surfaces 114 of the vertical tiers 108 and 110 are more clearly shown in the cross-sectional view of FIG. 10. It is the top surface 116 of the upper vertical tier 110 of the continuous sidewall 106 that supports the sun shade canopy 104 as will be discussed more fully hereinbelow with regard to FIGS. 6 and 11 enclosed herewith.

Figure 7:
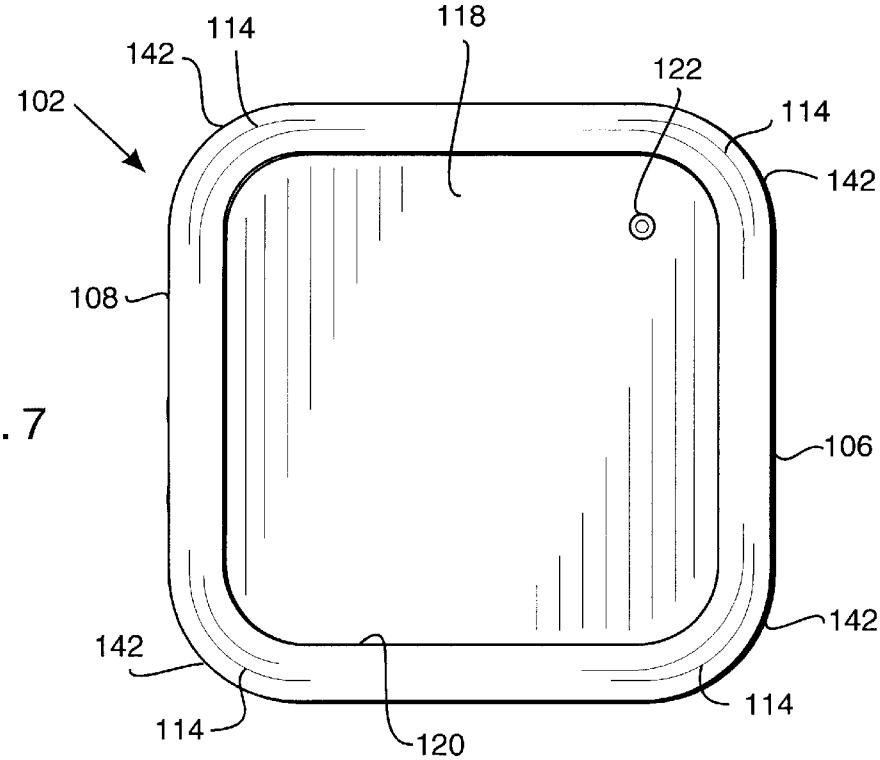
FIG. 7 is a bottom planar view of the sun shade pool of FIG. 1 showing a bottom wall of the inflatable pool attached to the multiple-tier inflatable sidewall and a drain plug formed in the bottom wall.
Figure 8:
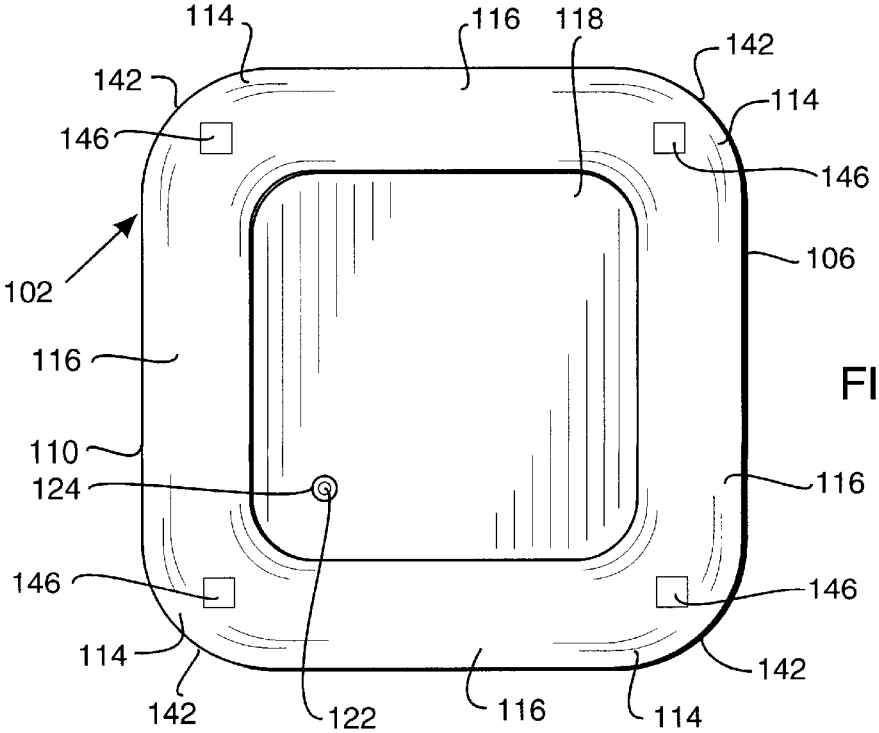
FIG. 8 is a top planar view of the sun shade pool of FIG. 1 with the sun shade canopy removed and showing the interior of the inflatable pool including the drain plug and the plurality of hook and loop fasteners affixed to the top surface of the inflatable sidewall.

The inflatable pool 102 also includes a bottom wall 118 as best shown in FIGS. 7 and 8 but is also partially shown in FIG. 1. The bottom wall 118 is also preferable comprised of polyvinylchloride sheeting but can be of a lower gauge thickness than the vertical tiers 108 and 110. The bottom wall 118, which serves as a floor surface, can be of a lower gauge thickness since it is not exposed to pressurized air. Thus, the gauge thickness of the bottom wall 118 is suitably selected for its intended use. The bottom wall 118 is sealed to the lower vertical tier 108 of the continuous sidewall 106 along a sealing line 120 as is best shown in FIG. 7. The sealing line 120 is not visible in the top planar view of the inflatable pool 102 shown in FIG. 8 because of the overhang of the top surface 116. The sealing or fusing of the bottom wall 118 to the vertical tier 108 is accomplished in a manner known in the art such as, for example, radio frequency sealing or adhesive sealing.

Thus, the polyvinylchloride sheeting of the bottom wall 118 is sealed or fused to the polyvinylchloride sheeting of the vertical tier 108 along sealing line 120 to complete the construction of the inflatable pool 102. The completed inflatable pool 102 is then capable of containing a fluid such as water which can be introduced into the inflatable pool 102 with, for example, a garden hose. Located within the polyvinylchloride sheeting of the bottom wall 118 is a drain plug 122. The drain plug 122 can be of, for example, a flexible or semi-rigid polyvinylchloride construction as is known in the art. The drain plug 122 typically includes a base flange 124 (see FIG. 8) which is fused as by radio frequency sealing to the polyvinylchloride sheeting about the perimeter of a penetration (not shown) formed in the bottom wall 118. The discharge end of the drain plug 122 passes through the penetration (not shown) and serves as an exit point for the water when the drain plug 122 is in the open position as is shown in FIG. 7.

Figure 9:
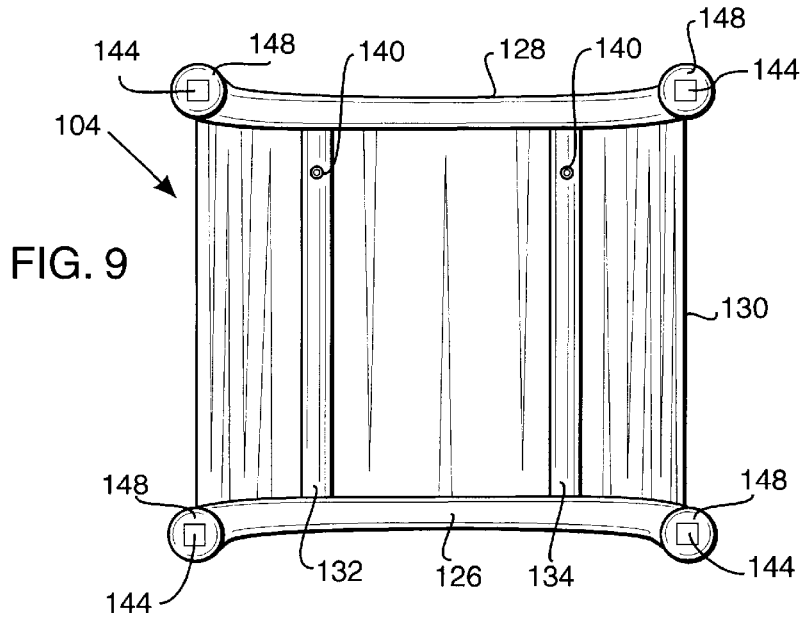
FIG. 9 is a bottom view of the canopy of the sun shade pool of FIG. 1 showing a pair of inflatable cross members with air valves which connect together the pair of inflatable arched tubes for supporting the fabric of the canopy and a plurality of co-mating hook and loop fasteners, one affixed to the bottom end of each inflatable arched tube.
Figure 10:
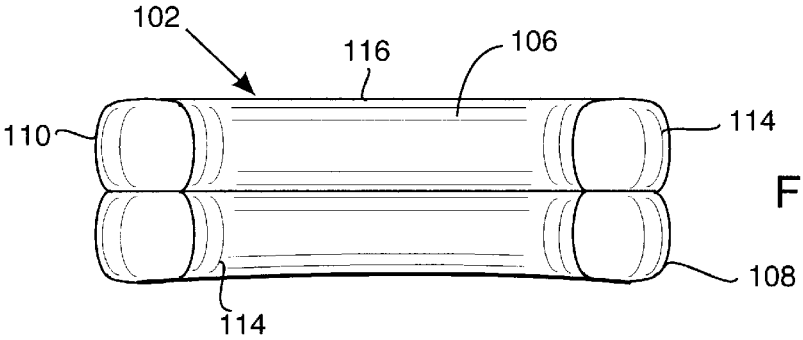
FIG. 10 is a cross-sectional view of the inflatable sidewall of the sun shade pool of FIG. 1 taken along the line 10—10 of FIG. 4 and showing the interior of the sidewall of the inflatable pool.
Figure 11:
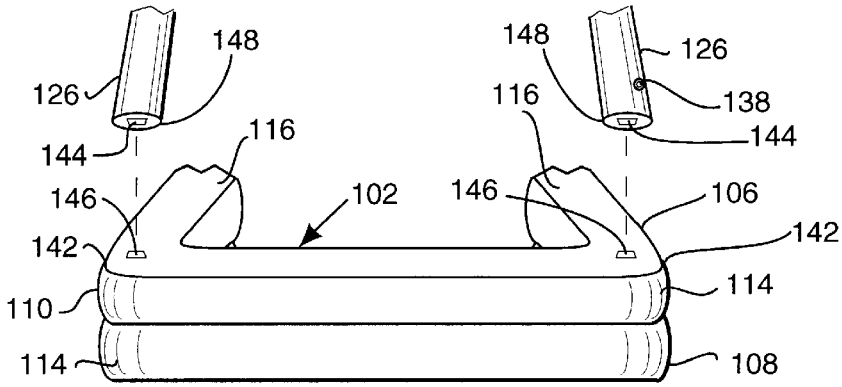
FIG. 11 is a detail view of the sun shade pool of FIG. 1 showing two of the co-mating hook and loop fasteners affixed to the bottom ends of one of the pair of inflatable arched tubes aligned with the corresponding hook and loop fasteners affixed to the top surface of the sidewall of the inflatable pool.

The sun shade canopy 104 comprises three main components including a pair of inflatable arched tubes, i.e., a first inflatable arched tube 126 and a second inflatable arched tube 128, and a sun blocking fabric 130. Each of the inflatable arched tubes 126 and 128 and the sun blocking fabric 130 are shown in FIGS. 1, 4, 5 and 6. Additionally, a pair of inflatable cross members, i.e., a first inflatable cross member 132 and a second inflatable cross member 134 are incorporated into the sun shade canopy 104 as shown in FIG. 9. The sun shade canopy 104 is attachable to and detachable from the inflatable pool 102 by a plurality of hook and loop fasteners 136 as is shown in FIGS. 1 and 11. It is noted that the entire interior volume of the inflatable pool 102 including the top surface 116 is covered by the sun shade canopy 104 as shown in FIG. 1. Thus, a child seated at any location within the interior of the inflatable pool 102 will be shaded from damaging sun rays during those hours of the day when the sun is directly above.

The first inflatable arched tube 126 and the second inflatable arched tube 128 serve to hold the sun blocking fabric 130 over the inflatable pool 102. The pair of inflatable arched tubes 126 and 128 are separated and structurally reinforced by the first inflatable cross member 132 and the second inflatable cross member 134 as is clearly shown in FIG. 9. Each of the inflatable arched tubes 126 and 128 are essentially identical in construction and form and are comprised of a robust flexible plastic such as, for example, polyvinylchloride sheeting. Each of the pair of inflatable arched tubes 126 and 128 include an inflation air valve 138 as known in the art for the insertion and discharge of pressurized air as is best shown in FIG. 1. Once inflated, the first and second inflatable arched tubes 126 and 128 adopt a generally U-shaped tubular arch form and are parallel mounted on opposite sides of the top surface 116 of the inflatable pool 102. The first and second inflatable arched tubes 126 and 128 are independent air chambers.

The first inflatable cross member 132 and the second inflatable cross member 134 are parallel positioned between and orthogonal to the first inflatable arched tube 126 and the second inflatable arched tube 128 as is shown in FIG. 9. The first and second inflatable cross members 132 and 134 are generally identical in shape and are typically straight, tubular-shaped independent air chambers. Each of the first and second inflatable cross members 132 and 134 include an inflation air valve 140 as known in the art for the insertion and discharge of pressurized air as is shown in FIG. 9. The first and second inflatable cross members 132 and 134 are sealed or fused to the first and second inflatable arched tubes 126 and 128 by means known in the art such as, for example, radio frequency sealing or adhesive sealing. The first and second inflatable cross members 132 and 134 once fused to the first and second inflatable arched tubes 126 and 128 form a stable structure.

The sun blocking fabric 130 serves to block the direct rays of the sun to protect the children playing in the inflatable pool 102. In the present invention, the sun blocking fabric 130 is suspended between the first and second inflatable arched tubes 126 and 128 as shown in FIG. 1. Likewise, the sun blocking fabric 130 is positioned over the first and second inflatable cross members 132 and 134 as shown in FIG. 9. Suspension of the sun shade fabric 130 between the first and second inflatable arched tubes 126 and 128 is accomplished by attaching the fabric 130 to each of the arched tubes 126 and 128 by a known method such as by the use of radio frequency sealing or adhesive sealing. Like the first and second inflatable arched tubes 126 and 128 and the first and second inflatable cross members 132 and 134, the sun blocking fabric 130 can also be comprised of polyvinylchloride sheeting. However, the sun blocking fabric 130 can also be formed of any one of a plurality of woven fabrics such as cotton.

In the present invention, the sun shade canopy 104 is attachable to and detachable from the inflatable pool 102 by a plurality of hook and loop fasteners 136 best shown in FIGS. 8, 9 and 11. The inflatable pool 102 is typically rectangular in shape but can adopt any geometric form. The top surface 116 of the rectangular-shaped inflatable pool 102 shown in FIG. 8 includes a plurality of four identical corners 142. Each hook and loop fastener 136 includes a hook portion 144 and a loop portion 146. One suitable method of attachment and detachment of the sun shade canopy 130 to the inflatable pool 102 is to affix as by gluing a hook portion 144 of a hook and loop fastener 136 to each of the two bottom ends 148 of each of the first and second inflatable arched tubes 126 and 128. Likewise, the loop portions 146 of the corresponding hook and loop fasteners 136 are affixed as by gluing to the top surface 116 of the inflatable pool 102 at each of the four identical corners 142. This design layout ensures that the hook portions 144 of the hook and loop fasteners 136 will intersect with the corresponding loop portions 146 and enable the sun shade canopy 104 to be conveniently attached to and removed from the top surface 116 of the inflatable pool 102.

The present invention provides novel advantages over other inflatable pools for use by small children known in the prior art. A main advantage of the sun shade pool 100 of the present invention is that the sun shade canopy 104 is removable, i.e., it is attachable to and detachable from the top surface 116 of the inflatable pool 102. This feature is helpful in transporting and storing the sun shade pool 100. Further, the sun shade canopy 104 is held in position by the pair of inflatable arched tubes 126 and 128 that utilize hook and loop fasteners 136 to attach to and detach from the inflatable pool 102. Thus, conventional mechanical attachment means are avoided. Additionally, the sun shade canopy 104 including the pair of support inflatable cross members 132 and 134 and the sun blocking fabric 130 cover the entire surface area of the inflatable pool 102. Consequently, the inventive sun shade pool 100 enables small children to obtain relief from hot weather and to enjoy splashing in water without exposure to direct sun rays. Further, the present invention eliminates the necessity for small children to be in the vicinity of a conventional swimming pool. Additionally, the sun shade pool 100 of the present invention is lightweight, easy to assemble and disassemble, and is robust and stable in construction.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A sun shade pool for use by children comprising:

an inflatable pool having a sidewall sealed to a bottom wall for containing a fluid;

a removable shade canopy for covering a top surface of said inflatable pool, said canopy having a pair of inflatable arched tubes attachably and detachably mounted to said top surface of said inflatable pool by a plurality of hook and loop fasteners, and a sun blocking fabric suspended between said pair of inflatable arched tubes; and a pair of inflatable cross-members positioned between said pair of inflatable arched tubes for supporting said canopy, said inflatable cross-members each being an independent air chamber.

2. The sun shade pool of claim 1 wherein said inflatable pool is comprised of flexible polyvinylchloride sheeting.

3. The sun shade pool of claim 1 wherein said pair of inflatable arched tubes are comprised of flexible polyvinylchloride sheeting.

4. The sun shade pool of claim 1 wherein said sun blocking fabric is comprised of flexible polyvinylchloride sheeting.

5. The sun shade pool of claim 1 wherein the sun blocking fabric is comprised of a woven fabric.

6. The sun shade pool of claim 1 wherein a first hook and loop fastener of said hook and loop fasteners is attached to a first of a pair of ends of a first of said inflatable arched tubes and a second hook and loop fastener of said hook and loop fasteners is attached to a second of a pair of ends of a second of said inflatable arched tubes, said first hook and loop fastener cooperating with said second hook and loop fastener for attachably mounting said removable shade canopy to said inflatable pool.

7. The sun shade pool of claim 1 wherein said inflatable pool includes at least one inflation air valve.

8. The sun shade pool of claim 1 wherein each of said inflatable arched tubes includes an inflation air valve.

9. The sun shade pool of claim 1 wherein said bottom wall of said inflatable pool includes a drain plug.

10. The sun shape pool of claim 1 wherein each of said inflatable cross-members includes an inflation air valve.

11. A sun shade pool for use by children comprising:

a inflatable pool having a sidewall sealed to a bottom wall for containing a fluid, said inflatable pool having a plurality of vertical tiers;

a removable shade canopy for covering a top surface of said inflatable pool, said canopy having a pair of inflatable arched tubes attachably and detachably mounted to said top surface of said inflatable pool by a plurality of hook and loop fasteners, said vertical tiers and said arched tubes each being an independent air chamber, and a sun blocking fabric suspended between said pair of inflatable arched tubes; and a pair of inflatable cross-members positioned between said pair of inflatable arched tubes for supporting said canopy, said inflatable cross-members each being an independent air chamber.

12. The sun shade pool of claim 11 wherein each of said inflatable cross-members includes an inflation air valve.

13. A sun shade pool for use by children comprising:

an inflatable pool having a sidewall sealed to a bottom wall for containing a fluid;

a removable shade canopy for covering a top surface of said inflatable pool, said canopy having a pair of inflatable arched tubes attachably and detachably mounted to said top surface of said inflatable pool by a plurality of hook and loop fasteners, and a sun blocking fabric suspended between said pair of inflatable arched tubes;

a pair of inflatable cross-members positioned between said pair of inflatable arched tubes for supporting said canopy, said inflatable cross-members each being an independent air chamber; and a plurality of air valves mounted in said sun shade pool for charging said inflatable pool and said inflatable arched tubes with air.

* * * * *